US005645031A

United States Patent [19]

Meneely

[11] Patent Number: 5,645,031

[45] Date of Patent: Jul. 8, 1997

[54] COMPRESSION RELEASE BRAKE WITH HYDRAULICALLY ADJUSTABLE TIMING

[76] Inventor: Vincent Allan Meneely, 9837 McKinnon Crescent, R.R. No. 10, Langley, British Columbia, Canada, V3A 6Y5

[21] Appl. No.: 588,083

[22] Filed: Jan. 18, 1996

[51] Int. Cl.[6] ..... F02D 13/04

[52] U.S. Cl. ..... 123/322; 123/321

[58] Field of Search ..... 123/321, 322, 123/90.12, 90.16; 251/129.18

[56] References Cited

U.S. PATENT DOCUMENTS

| | | | |
|---|---|---|---|
| 4,398,510 | 8/1983 | Custer | 123/90.16 |
| 4,475,500 | 10/1984 | Bostleman | 123/321 |
| 4,655,178 | 4/1987 | Meneely | 123/321 |
| 4,898,128 | 2/1990 | Meneely | 123/90.12 |
| 5,000,420 | 3/1991 | Hendrixon et al. | 251/129.08 |
| 5,011,043 | 4/1991 | Whigham et al. | 222/63 |
| 5,014,031 | 5/1991 | Nusser | 335/230 |
| 5,322,260 | 6/1994 | Forbes et al. | 123/129.18 |
| 5,340,032 | 8/1994 | Stegmaier et al. | 239/575 |
| 5,379,737 | 1/1995 | Hu | 123/322 |
| 5,462,025 | 10/1995 | Israel et al. | 123/321 |
| 5,513,673 | 5/1996 | Slavin et al. | 137/625.65 |
| 5,526,784 | 6/1996 | Hakkenberg et al. | 123/322 |

*Primary Examiner*—Raymond A. Nelli
*Attorney, Agent, or Firm*—Norman M. Cameron

[57] ABSTRACT

A pressure release brake for an internal combustion engine includes a master hydraulic actuator and a slave hydraulic actuator. The slave hydraulic actuator is operatively connected to the exhaust valve opening mechanism of one exhaust valve. The master hydraulic actuator is movable by an engine component to increase hydraulic pressure which moves the slave hydraulic actuator and opens the one exhaust valve near top dead center of compression strokes when the brake is operational. There is a lash adjusting mechanism for the slave hydraulic actuator. The lash adjusting mechanism includes a device for adjusting hydraulic pressure acting on the slave hydraulic actuator during exhaust strokes and thereby lash between the slave hydraulic actuator and the exhaust valve opening mechanism.

22 Claims, 4 Drawing Sheets

COMPRESSION RELEASE BRAKE WITH HYDRAULICALLY ADJUSTABLE TIMING

BACKGROUND OF THE INVENTION

This invention relates to compression release brakes and, in particular, to apparatuses for adjusting timing of such brakes during brake operation by varying hydraulic pressure acting on the slave piston.

Compression release brakes are well known and are typically employed on large diesel engines used to power vehicles. In theory the compression of a charge in an engine should slow the vehicle when the fuel supply to the engine is cut off so as to reduce reliance upon the wheel brakes. However there is a rebound effect after the charge in each cylinder has been compressed by the piston. The compressed gases in each cylinder after the compression stroke tend to act against the piston and drive it away from the cylinder head, effectively counteracting the braking effect just described.

It was realized in the past that this rebound effect could be removed by opening each exhaust valve at a time when the valve would normally be closed, namely when the piston is near the top dead center position of the compression stroke. The compressed gases therefore are released through the exhaust valve into the exhaust manifold, removing the rebound effect so that the compression of gases in the cylinder in fact achieves the desired braking effect.

The most common type of engine brake utilizes a master hydraulic cylinder connected to a slave hydraulic cylinder by a hydraulic system. The master cylinder has a master piston which operatively contacts some component of the engine which reciprocates the piston of the master cylinder at the desired time near the top dead center position for each cylinder of the engine. The slave cylinder has a slave piston which operatively engages the exhaust valve opening mechanism. Accordingly, when the master piston is reciprocated, the slave piston bears against the exhaust valve opening mechanism, opening the exhaust valve near the top dead center position on the compression stroke.

These brakes are usually controlled by a switch mounted in the cab of the vehicle connected to a solenoid valve. The solenoid valve provides hydraulic fluid to the engine brake to render it operational.

Time is critical for optimal operation of such engine brakes. If the exhaust valve is opened too early, then the braking force is not maximized since compression is lost before the air in the cylinder is completely compressed. However, if the timing is left too late, then it may be difficult to open the exhaust valve against the force of the compressed gases in the cylinder. This may place too heavy a load on the engine. Alternatively, the compressed gases may not be released on time to avoid some rebound effect. Timing which may be ideal or acceptable at low engine speeds may be too late at higher engine speeds, leading to unacceptably high loading as discussed above.

Typically such timing problems are dealt with by the amount of gap or lash between the slave piston and the exhaust valve opening mechanism. A number of previous patents have provided different approaches to adjusting the lash and accordingly the timing. For example, my own earlier U.S. Pat. No. 4,655,178 and 4,898,128 revealed devices which can take up lash during brake operation in whole or in part. It is even possible to achieve a state of negative lash wherein the valves are held open to some degree throughout operation of the brake.

However it is desirable in some circumstances to provide lash adjustment on an ongoing basis during operation of the engine and brake. One approach to this is found in U.S. Pat. No. 5,379,737 to Hu which discloses an electrically controlled timing adjustment for compression release brakes. In this patent a solenoid-activated member pushes on the slave piston to reduce or eliminate the gap between the slave piston and the valve operating mechanism.

Other patents outlining methods of achieving slave piston lash control include U.S. Pat. No. 4,398,510 and 4,475,500.

Most of the prior art attempts at lash control sacrifice low speed performance apart from the Hu patent discussed above. As fuel economy concerns rise, engines are being operated at lower speeds, resulting in better economy, but poor engine brake performance with conventional engine brakes.

Accordingly it is an object of the invention to provide an improved compression release brake which overcomes the deficiencies associated with the prior art devices but is simple in construction, reliable in operation and economical to produce.

It is also an object of the invention to provide an improved compression release brake which improves brake performance at lower engine speeds compared to prior art devices.

It is a further object of the invention to provide an improved compression release brake which allows the timing of the brake to be adjusted during engine operation to improve performance.

It is a still further object of the invention to provide an improved compression release brake with the capability of selecting between at least two different slave piston lash settings during operation of the brake.

SUMMARY OF THE INVENTION

These and other objects of the invention are achieved by providing a compression release brake for an internal combustion engine having exhaust valves with exhaust valve opening mechanisms. The brake includes a master hydraulic actuator which is hydraulically connected to a slave hydraulic actuator. The slave hydraulic actuator is operatively connected to the exhaust valve opening mechanism of one said exhaust valve. The master hydraulic actuator is movable by an engine component to move the slave hydraulic actuator and open said one exhaust valve near top dead center of compression strokes when the brake is operational. There is a lash adjusting mechanism for the slave hydraulic actuator. The lash adjusting mechanism includes means for adjusting hydraulic pressure acting on the slave hydraulic actuator during exhaust strokes and thereby lash between the slave hydraulic actuator and the exhaust valve opening mechanism.

Preferably the slave hydraulic actuator is biased away from the exhaust valve opening mechanism.

In one example of the invention, the lash adjusting mechanism includes a mechanical device biasing the slave hydraulic actuator towards the exhaust valve opening mechanism in concert with hydraulic pressure acting on the slave hydraulic actuator.

The means for adjusting may include an adjustable pressure relief valve with a valve member held against a seat by an adjustable biasing mechanism.

Another aspect of the invention provides a method of selectively adjusting lash between the slave piston of a compression release brake and a valve train of an exhaust valve of an internal combustion engine. The method includes the step of varying hydraulic pressure acting against the slave piston. The hydraulic pressure may be varied by changing the hydraulic pressure when the brake is operational. This may be done with an hydraulic pressure relief valve.

The invention offers distinct advantages when compared with prior art devices. Overloading of the engine at high speeds may be eliminated, while allowing for enhanced operation of the brake at lower engine speeds. Moreover the device is well adapted to changing lash during brake operation according to requirements such as engine speed. In its simplest form the device can provide two different alterative lash settings, one for low engine speeds and one for higher speeds. However, because the device can be operated by an electrical actuator, it is well adapted for electronic control. Changing the hydraulic pressure between lower pressure and higher pressure points for varying intervals of time effectively gives a continuous range of pressures and lash settings available between the two extremes. The extreme lash setting at the higher pressure position may even be a negative lash wherein the exhaust valve is prevented from closing completely.

DESCRIPTION OF THE PREFERRED EMBODIMENTS

Figure 1:
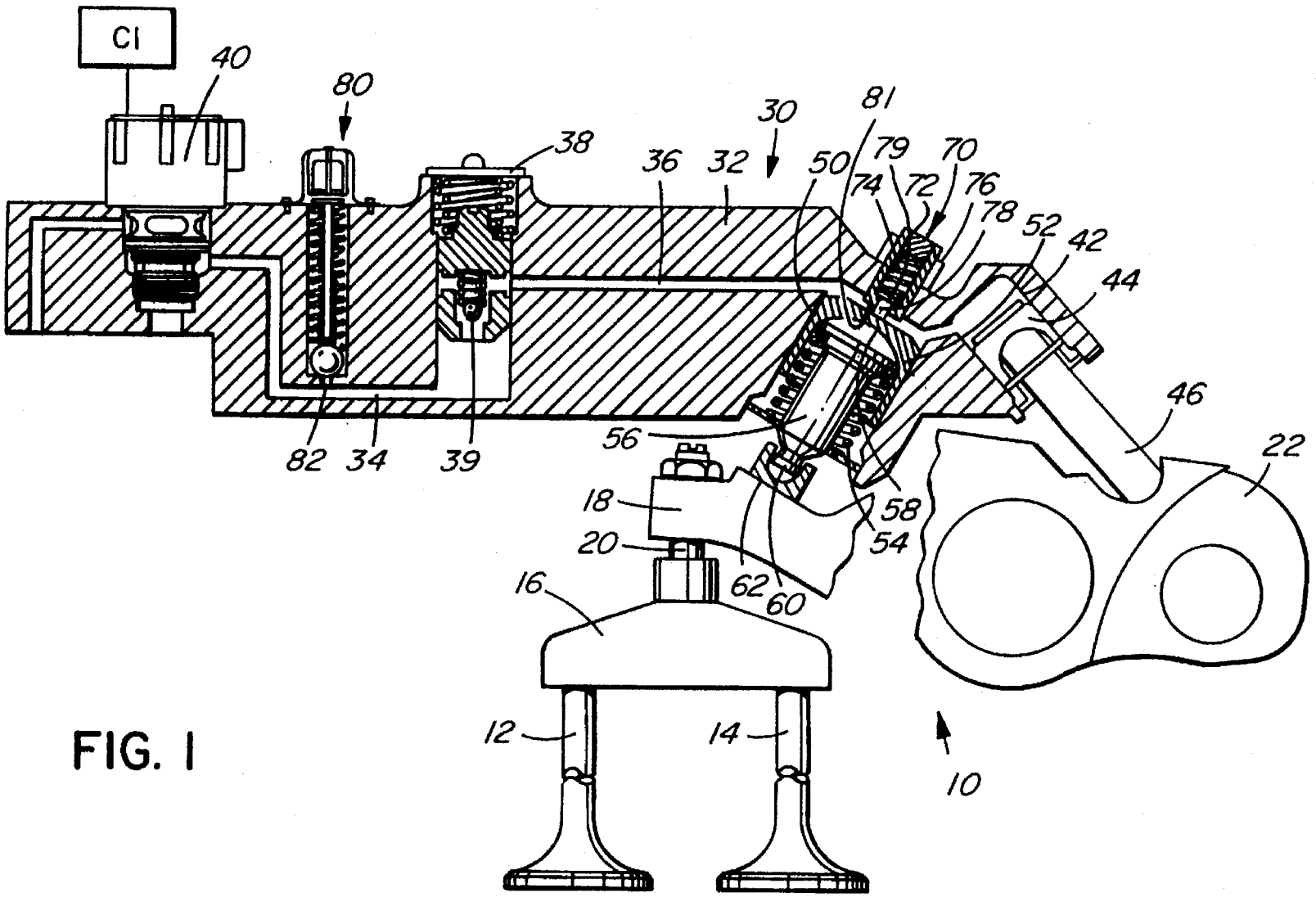
FIG. 1 is a sectional view of a compression release brake according to an embodiment of the invention.

Referring to the drawings, FIG. 1 shows an internal combustion engine generally at 10. Only fragments of the engine are shown including exhaust valves 12 and 14 of one cylinder which are operatively connected by a cross head 16. The device also works on engines with one exhaust valve per cylinder. The valves are opened during normal engine operation by a rocker arm 18 which has an adjustment screw 20 bearing on the cross head. Also shown in fragment is fuel injector rocker arm 22 for another cylinder of the engine.

The engine 10 is equipped with a compression release brake 30. It should be understood that there would be additional components of the compression release brake, not shown, for additional cylinders of the engine. Normally all of the cylinders would be equipped with similar mechanisms as described below.

The brake includes a housing 32 typically mounted within the cylinder head cover of the engine. The housing has a hydraulic conduit 34 and a hydraulic conduit 36 with a control valve 38 located therebetween. There is a solenoid shut off valve 40 on conduit 34 which is normally open. However the valve can be closed by means of controls C1 so as to maintain hydraulic pressure in the conduit 34. The controls C1 are conventional and would normally include a manual switch in the cab of the vehicle as well as switches connected to the throttle and to the clutch to ensure that the fuel supply to the engine is cut off and the clutch is engaged when the brake is operational. The control valve 38 has an internal check valve 39 which permits oil to enter conduit 36 when the brake is operational, but prevents an outflow of oil from conduit 36 past the valve 38.

The brake 30 has a generally conventional master/slave cylinder arrangement including a master cylinder 42 equipped with a master piston 44 reciprocatingly received therein. The piston 44 has a piston rod 46 operatively connected to a fuel injector rocker arm 22 whereby the piston 44 is reciprocated into the cylinder (upwardly in FIG. 2) when the rocker arm 22 is actuated. Other suitable engine components could actuate the master piston besides this rocker arm.

The master cylinder is hydraulically connected to a slave cylinder 50 by a portion of hydraulic conduit 36. There is a slave piston 52 reciprocatingly received within the slave cylinder. The slave piston is resiliently biased away from rocker arm 18 by a coil spring 54 in this example. There is a generally cylindrical member 56 mounted within recess 58 of the slave piston having a ball member 60 which rotatably engages socket member 62 mounted on rocker arm 18. Thus, when hydraulic pressure in the conduit 36 is maintained, movement of master piston 44 into the master cylinder depresses the slave piston in the slave cylinder towards the rocker arm 18, causing exhaust valves 12 and 14 to crack open. The fuel injector rocker arm 22, or some other component of the engine, is chosen such that it moves at the same time or just prior to the desired cracking open of the exhaust valves. As is known in the art, the exhaust valves are cracked open during brake operation just prior to top dead center of the compression stroke of the particular cylinder involved.

As described above, the engine brake is conventional and would be fully understood by someone skilled in the art. Therefore these aspects of the brake will not be described in more detail.

Also previously known, though less conventional, is the type of mechanical lash adjusting device 70 utilized on brake 30. This includes a hollow screw 72 with a coil spring 74 located therein. The screw threadedly engages a corresponding female threaded aperture in housing 32. There is a nut 76 used to lock the screw in a particular position. A movable finger 78 is reciprocatingly received inside the hollow screw and is biased towards slave piston 52 by the coil spring 74. Travel of the finger towards the slave piston is limited by a flange 79 at the top of the finger contacting a flange 81 at the bottom of the hollow screw. This mechanism is generally same as that disclosed in my earlier U.S. Pat. No. 4,655,178. In the position shown, the finger 78 is extended the maximum amount and is against the slave piston. Thus the coil spring 74 in the lash adjusting device 70 tends to oppose the force of coil spring 54 of the slave piston when the finger 78 contacts the slave piston. However coil spring 74 exerts significantly less force than the coil spring 54 and thus the device 70 itself is not capable of depressing the slave piston against the force of the coil spring 54.

As is conventional for such devices, lash may be provided in the engine brake in the form of a gap between the slave piston and the valve opening mechanism. This gap may, for example, appear between the socket member 62 and the rocker arm 18. As stated above, the mechanical device 70 alone is not capable of taking up this lash. However the force of the finger 78 upon the slave piston can take up all or part of the lash in conjunction with sufficient hydraulic pressure in conduit 36. The contribution of the mechanical device 70 can be altered by moving the screw 72 towards or away from the slave piston, and thus adjusting the force of spring 74. However this cannot be done conveniently while the engine is operational.

The exhaust valves 12 and 14 open in the normal course of engine operation during the exhaust stroke. When this occurs the spring 54 acting against slave piston 52 tends to hold it in the position shown. Spring 74 together with finger 78 and the oil pressure from conduit 36 tend to move the piston towards rocker arm 18 when the oil pressure is sufficiently great. The oil pressure is not sufficient to move the piston 52 against the pressure of spring 54 by itself, but only in conjunction with finger 78 and spring 74. Thus lash between the slave piston and the rocker arm can be taken up in this manner or even negative lash induced whereby the exhaust valves are held open. The total movement of the piston 52 towards rocker arm 18 during the exhaust stroke is limited by the travel of finger 78. The slave piston is thereafter prevented from returning to its original position by oil which passes by check valve 39 and is thereby locked in the system above the piston.

For example the finger 78 may have a maximum travel towards the slave piston of 0.030".

There may be 0.025" lash between the slave piston and the rocker arm 18. Thus the finger and oil pressure take up the complete lash and produce a negative lash of 0.005". In other words, the exhaust valves are held open a minimum 0.005" during brake operation.

The negative lash described above is preferred for high engine speeds but is undesirable at low engine speeds. The timing of the engine brake would be too early and exhaust turbine boost pressure is reduced for engines with brakes timed in this manner. On the other hand the lash of 0.025" would be too great in some instances. At high engine speeds engine loading would be too great in some instances. Thus it would be desirable to change the lash for different engine operating modes such as high and low speed operation.

The specific means utilized in this embodiment is to adjust lash during brake operation is pressure relief valve 80 which is mounted on housing 32. It is hydraulically connected to hydraulic conduit 34 by means of a short hydraulic conduit 82. The valve is shown in better detail in FIG. 2. The valve includes an elongated chamber 84, cylindrical in this example, formed in the housing 32. The chamber has a first end 86 and a second end 88. There is a valve seat 90 at the first end 86 between the chamber and conduit 82 which acts as an inlet for hydraulic fluid.

Figure 2:
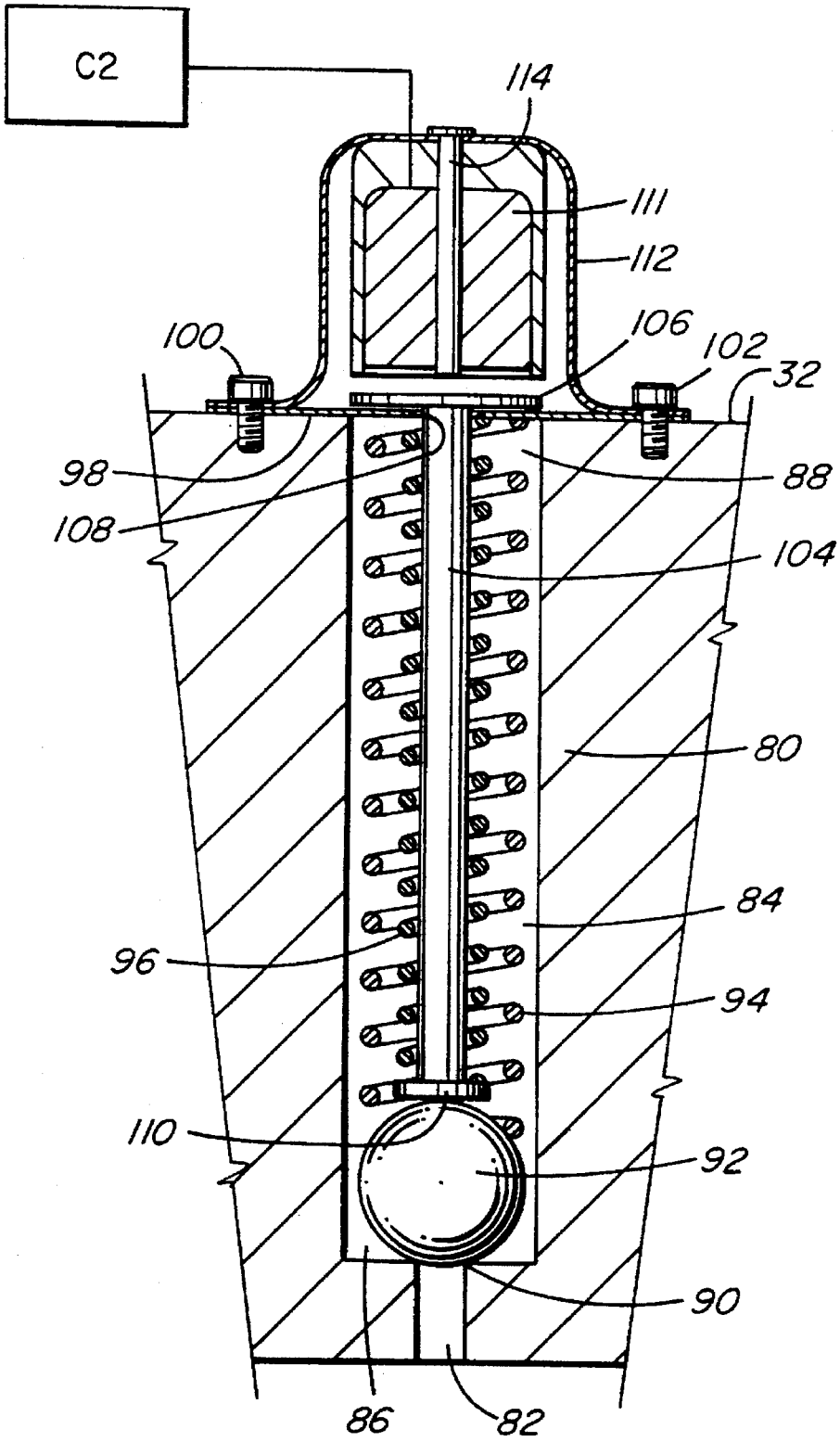
FIG. 2 is a partly diagrammatic, sectional view of the pressure regulating valve thereof.

There is a valve member, in this case a ball 92, which normally closes the valve by contact with valve seat 90 as shown in FIG. 2. The ball 92 is held in this position by a pair of coaxial coil springs 94 and 96. There is an annular member 98 adjacent the second end 88 of the chamber which is secured to the housing by means of a pair of screws 100 and 102. Outer coil spring 94 is compressed between the annular member 98 and the ball 92 to bias the ball against the valve seat 90.

There is a shaft 104 which in this example extends along the center line of chamber 84. The shaft is connected to a disc-shaped armature 106 which is exterior to the housing 32 in this example. The shaft extends slidably through aperture 108 in member 98 and has a closure member 110, disc-shaped in this embodiment, at the opposite end which is shown against ball 92 in the position of FIG. 2. The inside coil spring 96 is biased between annular member 98 and the closure member 110, thus tending to keep the shaft in the position shown and the ball 92 closed against seat 90.

There is a solenoid 111 mounted on the housing 32 by means of bracket 112 and screws 100 and 102. The solenoid has a core 114 spaced-apart from armature 106 in the position shown in FIG. 2. The solenoid is connected to controls C2 which, in simplest form, include a switch connected to a source of electrical current to energize the solenoid.

In the position of valve 80 shown in FIG. 1 and 2, both coil springs 94 and 96 bear against ball 92, thus exerting the maximum force on the ball for the particular configuration of valve 80 and maintaining the maximum pressure in hydraulic conduit 34. The preferred pressure is dictated by a number of factors including the forces exerted by coil springs 54 and 74. The two coil springs acting together provide pressure release through valve 80 only at a high pressure setting which is sufficient to move the slave piston against the pressure of spring 54 when the pressure is acting in conjunction with spring 74 and finger 78. The corresponding lash in the slave cylinder is then at a minimum, 0 or even negative lash where the exhaust valve is held slightly open throughout operation of the brake.

The lash may be increased by eliminating the effect of coil spring 96 in valve 80. This is done by solenoid 111 drawing armature 106 towards core 114. This lifts closure member 110 away from ball 92 against the pressure of coil spring 96. Thus only coil spring 94 then holds ball 92 against seat 90. A reduced pressure in conduit 34 can then unseat the ball from the valve seat and the pressure in the conduit 34 is thereby reduced. This low pressure in conduit 34, and consequently in conduit 36, acts on the slave piston together with the mechanical device 70. The total force acting on the slave piston is thereby reduced as is the force countering coil spring 54. The lash is maximized when the total force acting on the slave piston is insufficient to depress spring 54 when the exhaust valves 12 and 14 are open during the exhaust stroke. However this maximum lash setting may be decreased depending upon the hydraulic pressure in line 36 and the force exerted by device 70 as adjusted by screw 72. As described above, the minimum pressure in the hydraulic line, and the maximum lash, depends on the force exerted by the single coil spring 94.

The description above relates to the simplest mode of operation of the device whereby there are two possible lash settings available for the engine. These settings can be selected automatically by controls C2 depending upon such factors as engine speed. The increased lash is obtained by activating solenoid 111 and the decreased lash by deactivating this solenoid.

Control C2 could be activated by a pressure sensor responsive to the boost pressure in the intake system of engines equipped with turbo chargers. A diaphragm type sensor is suitable for example with a normally closed switch.

Alternatively, electronic engine monitoring systems can be utilized to adjust the lash according to engine speed, boost pressure or both. The controls are then arranged to activate solenoid 111, and thereby produce positive lash in the example above, until the boost pressure reaches a specified level. At this point the solenoid is deactivated which increase the hydraulic pressure and produces negative lash in the example above. In the event of failure of the system the safer negative lash results at all boost pressures or engine speeds.

However the controls C2 can be configured to provide a continuous spectrum of lash adjustment between the two extremes described above. Thus, for example, the lash can be continuously adjusted according to engine speed or other operational factors. The lash can vary between a positive lash for low speed engine operation and a negative lash for high speed engine operation. It may also be varied according to turbo charger boost pressure or a combination of this boost pressure and engine speed. This continuous variation can be provided in an number of ways. One method is by cycling the solenoid 111 on and off at a high frequency. Controls for accomplishing this are conventional. The armature 106 is retracted further depending upon the amount of time the solenoid is cycled "on". Accordingly this increases the lash.

Figure 3:
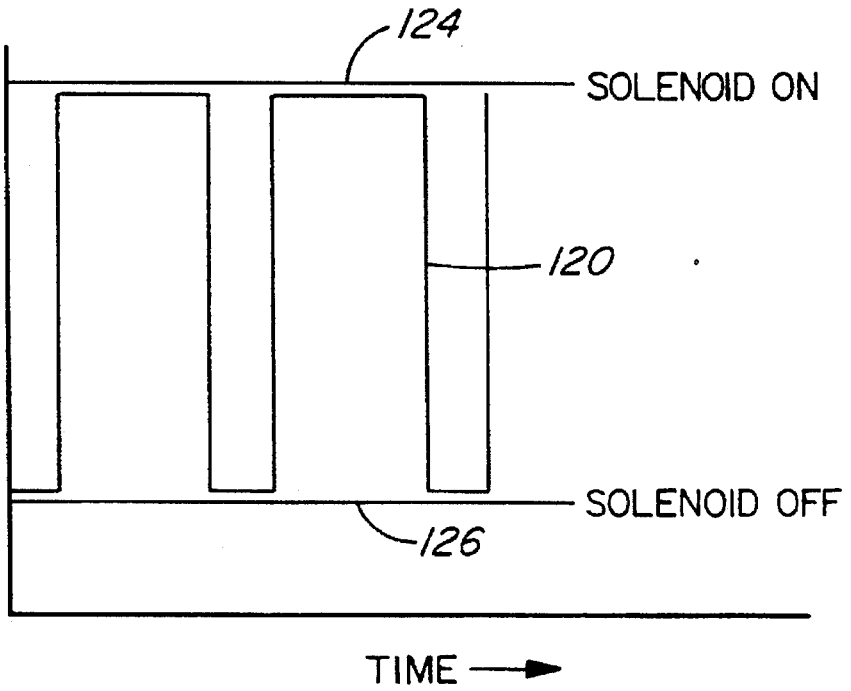
FIG. 3 is a graph showing operation of a pulsating lash adjusting device for the brake of FIG. 1.
Figure 4:
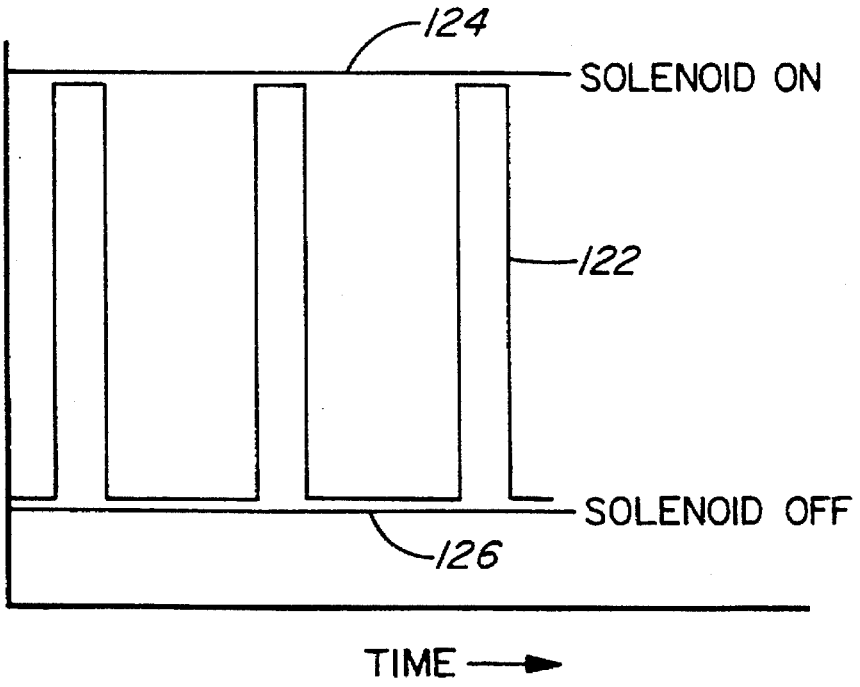
FIG. 4 is a graph similar to FIG. 3 where the solenoid is pulsed on for a shorter portion of time.

With reference to FIG. 3 and 4 the solenoid is turned on and off rapidly so the effect is to retract armature 106 greater or lesser amounts of time. When the armature is pulsed on for longer periods than off, as shown by the pulses 120 of FIG. 3, the hydraulic pressure is less than when the armature is pulsed on shorter periods than off as shown by the pulses 122 of FIG. 4. Therefore the lash is greater for the cycle of FIG. 3 compared to FIG. 4. The maximum lash, 0.025" in the example above, is when the solenoid is always on as shown by line 124 in FIG. 3 and 4. The "minimum" lash, being the negative lash of 0.005" in the example above, occurs when the solenoid is always off as shown by line 126 in FIG. 3 and 4.

The spring 54 exerts a greater force the further it is compressed but spring 74 and finger 78 exert a smaller force on the piston 52 the further the spring 74 extends. Therefore the movement of piston 52 on the exhaust stroke, and amount of lash taken up, can be varied by varying the pulse duration when the solenoid is on and accordingly the hydraulic pressure acting on piston 52 during the exhaust stroke.

Another alternative embodiment has three modes of operation. The first is when the solenoid is de-energized for the −0.005" lash in the example described above. The second is with the solenoid fully energized throughout brake operation for the +0.025" lash described above. The third mode is zero lash. In this mode, the first mode with spring 94 retracted is maintained while the exhaust valves are open. Once the rocker arm 18 returns to the portion of FIG. 1 the solenoid is de-energized. This gives a condition of zero lash and a third alternative for the positive and negative lashes described above.

Figure 5:
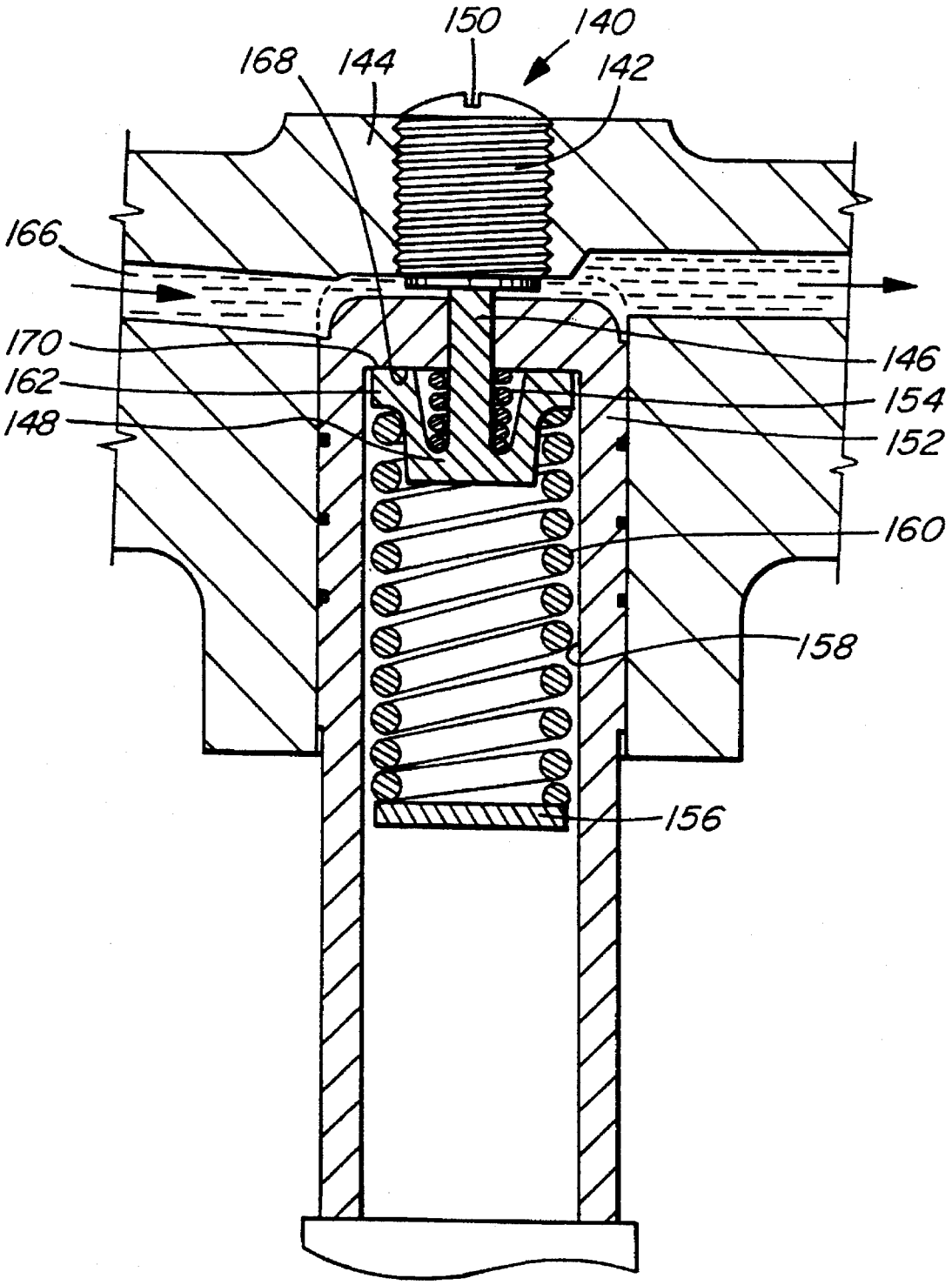
FIG. 5 is a sectional view of an alternative lash adjusting device by Cummins which may be utilized with the invention.

FIG. 5 is a sectional view of a lash adjusting device as disclosed in U.S. Pat. No. 4,475,500 to Bostelman which was assigned to Cummins Engine Company, Inc. The invention may also be used in conjunction with a device having a similar structure in place of the lash adjusting device 70 described above. As disclosed in the earlier Cummins patent, lash adjusting device 140 includes a threaded adjusting screw 142 which is received in a threaded opening in housing 144. This screw abuts against a central bolt-like portion 146 of a lash compensator element 148. There is a slot 150 in the head of screw 142 in this embodiment allowing it to be rotated by a screw driver. There is an actuating piston 152 which is held against screw 142 by a first, relatively light spring 154. There is a fixed support 156 part way down internal cavity 158 of the piston 152. A second relatively stiff spring 160 is fitted between the support 156 and shoulder 162 of lash compensator 148.

Device 140 may be used, for example, with the previous embodiment described above where there are two possible lash settings as determined by the position solenoid 111 of the embodiment of FIG. 2. As explained above, in the position of valve 80 shown in FIG. 1 and 2, both coil springs 94 and 96 bear against ball 92, thus exerting the maximum force of the ball and giving a corresponding high oil pressure which occurs in conduit 166 when used in conjunction with the embodiment FIG. 5. This high pressure is enough when acting upon the top of piston 152 to overcome the pressure of spring 154 and move the piston downwardly when the exhaust valve is open during the exhaust stroke to take up some or all of the lash which is normally provided between surface 168 on the top of lash compensator 148 and surface 170 inside the top of the piston 152. When the solenoid 111 retracts the spring 96, as seen in FIG. 2, the pressure in conduit 166 is reduced. This reduced pressure is insufficient to overcome the force of spring 154 when the exhaust valve is open. Accordingly lash adjustment is provided by the means for adjusting hydraulic pressure in the form of the solenoid 111 and valve 80 described above.

Other known mechanisms could be substituted for the solenoid 111 in valve 80 to vary the hydraulic pressure and adjust the lash in the embodiment described above.

It will be understood by someone skilled in the art that many of the features described above are by way of example only and are not intended to limit the scope of the invention which is to be interpreted with reference to the following claims.

What is claimed is:

1. A compression release brake for an internal combustion engine having exhaust valves with exhaust valve opening mechanisms, the brake comprising a master hydraulic actuator, a slave hydraulic actuator hydraulically connected to the master hydraulic actuator, the slave hydraulic actuator being operatively connected to the exhaust valve opening mechanism of one said exhaust valve, the master hydraulic actuator being movable by an engine component to move the slave hydraulic actuator and open said one exhaust valve near top dead center of compression strokes when the brake is operational, and a lash adjusting mechanism for the slave hydraulic actuator, the lash adjusting mechanism including means for adjusting hydraulic pressure acting on the slave hydraulic actuator during exhaust strokes and thereby adjusting lash between the slave hydraulic actuator and the exhaust valve opening mechanism on each compression stroke prior to opening said one exhaust valve.

2. An engine brake as claimed in claim 1, wherein there is means for biasing the slave hydraulic actuator away from the exhaust valve opening mechanism.

3. A compression release brake as claimed in claim 2, wherein the means for biasing is a spring.

4. A compression release brake as claimed in claim 3, wherein the spring is a coil spring.

5. A compression release brake as claimed in claim 4, wherein the slave hydraulic actuator includes a slave piston, the spring biasing the piston away from the exhaust valve opening mechanism.

6. A compression release brake as claimed in claim 2, wherein the lash adjusting mechanism includes a mechanical device biasing the slave hydraulic actuator towards the exhaust valve opening mechanism in concert with hydraulic pressure acting on the slave hydraulic actuator.

7. A compression release brake as claimed in claim 6, wherein the slave hydraulic actuator includes a slave piston, the mechanical device including a member with limited travel resiliently biased against the slave piston.

8. A compression release brake as claimed in claim 1, wherein the means for adjusting includes an electrical actuator.

9. A compression release brake as claimed in claim 8, wherein the actuator includes a solenoid.

10. A compression release brake as claimed in claim 1, wherein the means for adjusting includes an adjustable pressure relief valve.

11. A compression release brake as claimed in claim 10, wherein the valve includes a valve member biased against a valve seat by an adjustable biasing mechanism.

12. A compression release brake as claimed in claim 10, wherein the pressure relief valve has a valve seat and a valve member, first means for biasing the valve member towards the valve seat, second means for biasing the valve member towards the valve seat and means for selectively engaging the second means with the valve member.

13. A compression release brake as claimed in claim 12, wherein the means for selectively engaging includes an electromagnetic actuator and means for pulsing the actuator on and off.

14. A compression release brake, comprising:

a hydraulic conduit;

a master cylinder hydraulically connected to the conduit having a master piston reciprocatingly received therein, the master piston being operatively connected to an engine component capable of reciprocating the master piston;

a slave cylinder hydraulically connected to the conduit having a slave piston reciprocatingly received therein, the slave piston having means for operatively engaging an exhaust valve of an internal combustion engine when the brake is installed therein and means for biasing the slave piston away from engagement with the exhaust valve;

a mechanical device acting on the slave piston against the means for biasing for a limited distance; and means for adjusting lash between the slave piston and the exhaust valve during operation of the brake and during exhaust strokes of the engine, the means for adjusting comprising a pressure relief valve hydraulically connected to the conduit including a valve body having a valve member therein resiliently biased against the valve seat by a first spring and selectively by a second spring, a spring compressing member being connected to the second spring, a solenoid mounted on the valve body, an armature adjacent the solenoid and operatively connected to the spring compressing member, whereby the second spring is compressed and moved away from the valve member when the solenoid is energized, pressure in the conduit being sufficient to overcome the means for biasing in concert with the mechanical device when the second spring uncompressed by the spring compressing member and insufficient when compressed.

15. An engine equipped with the brake of claim 14.

16. A method of selectively adjusting lash between a slave piston of a compression release brake and a valve train of an exhaust valve of an internal combustion engine on each compression stroke prior to cracking open said exhaust valve, comprising the step of varying hydraulic pressure acting against the slave piston.

17. A method as claimed in claim 16, including the step of varying hydraulic pressure action on the slave piston when the exhaust valve is open.

18. A method as claimed in claim 17, wherein the pressure is varied by changing relief pressure of a pressure relief valve.

19. A method as claimed in claim 18, wherein the pressure of the valve is changed by actuating a solenoid.

20. A method as claimed in claim 19, wherein the solenoid is pulsed on and off to vary the pressure.

21. A method as claimed in claim 16, wherein the lash is adjusted by a limited travel mechanical device acting on the slave piston together with the hydraulic pressure when the exhaust valve is open.

22. An adjustable pressure relief valve, comprising:

a valve seat;

a valve member engageable with the valve seat;

adjustable means for biasing the valve member towards the valve seat, the adjustable means including a spring and means for selectively engaging the spring with the valve member, the means for selectively engaging including a solenoid; and an elongated chamber having a first end and a second end, a hydraulic fluid inlet at the first end, the valve seat being about the inlet and the valve member sealingly engaging the seat when the valve is closed, a first coil spring extending from the first end of the chamber and biased against the valve member, the solenoid being adjacent the second end, an armature movable by the solenoid, a shaft extending through the chamber and having a first end connected to the armature and a second end having a closure member, a second coil spring extending about the shaft, the closure member being biased against the valve member when the solenoid is inactive and the closure member being spaced-apart from the valve member when the solenoid is activated and the armature is moved by the solenoid.

* * * * *